US005163475A

United States Patent [19]

Gregoire

[11] Patent Number: 5,163,475

[45] Date of Patent: Nov. 17, 1992

[54] GAS DELIVERY PANELS

[75] Inventor: Roger J. Gregoire, San Antonio, Tex.

[73] Assignee: Praxair Technology, Inc., Danbury, Conn.

[21] Appl. No.: 798,580

[22] Filed: Nov. 26, 1991

[51] Int. Cl.[5] ..... F17C 7/00

[52] U.S. Cl. ..... 137/597; 137/861

[58] Field of Search ..... 62/45.1; 137/597, 861, 137/613

[56] References Cited

U.S. PATENT DOCUMENTS 4,489,721 12/1984 Ozaki ..... 137/597 X
4,597,416 7/1986 Scales ..... 137/597 X
4,685,156 8/1987 Brabazon ..... 137/597 X

FOREIGN PATENT DOCUMENTS 3806998 9/1988 Fed. Rep. of Germany .

OTHER PUBLICATIONS

"Purge Panels", 1989, Flopure, Inc., pages 2 (total).
"Ceodeux", Since 1922-Technology, pages 5 (total) Gas Systems.
"Answering the Challenge for You", AT Series Manual Gas Control Manifolds for Ultra-High Purity Toxic, Flammable and Corrosive Gases, Semi Gas Systems, Inc., 1986, pages 6 (total).
SDC UHP High Pressure Cylinder Source Gas Panel, SDC 2190-13, Nov. 1990, pages 2 (total).

*Primary Examiner*—Alan Cohan
*Attorney, Agent, or Firm*—Alvin H. Fritschler

[57] ABSTRACT

A micropanel for the delivery of gas from a supply cylinder to a tool location comprises an arrangement of valves, pressure regulator and associated components adapted to enhance the purity of the delivered gas and the safety of the gas delivery panel.

26 Claims, 1 Drawing Sheet

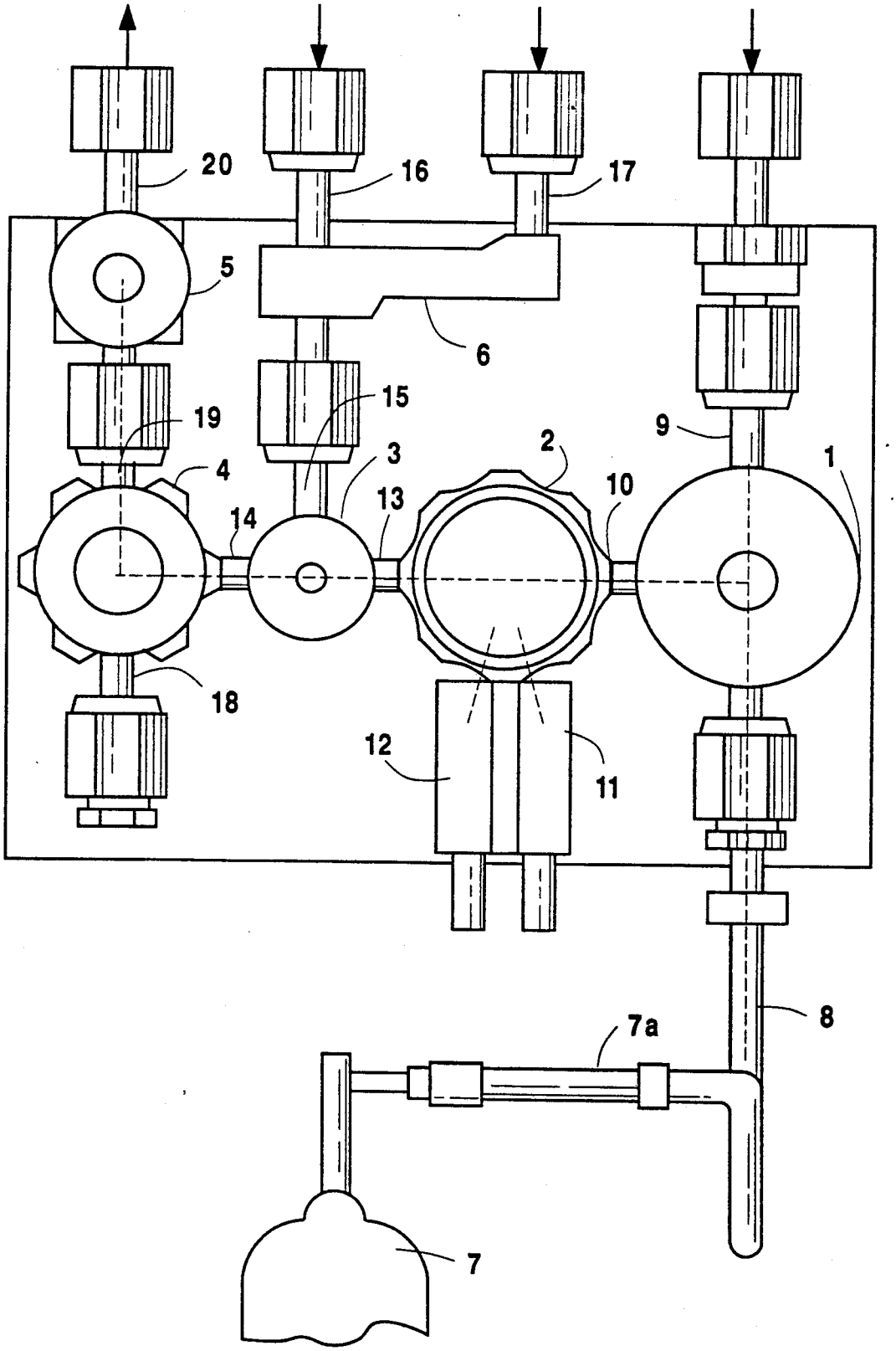
20
16
17
5
6
15
19
9
2
3
1
4
10
13
14
18
12
11
8
7a
7

GAS DELIVERY PANELS

BACKGROUND OF THE INVENTION

1. Field of the Invention

The invention relates to gas panels for supplying high purity process gas to a point-of-use location. More particularly, it relates to an improved gas panel having enhanced reliability and reduced potential of gas contamination.

2. Description of the Prior Art

In the semiconductor manufacturing industry and in various other industrial operations, gas cabinets are used to deliver high purity process gases to a point-of-use location, commonly referred to as a tool location. Such cabinets contain high purity gas supply cylinders and gas panels for delivering gases to the tool location.

For high purity gas operations, it is essential that the process gases be delivered to the tool location with minimum contamination since even parts-per-million impurity levels can adversely affect the efficiency of semiconductor and other high purity products. In addition, it is necessary to assure that the gas panels are capable of operating safely and without gas leakage that could jeopardize the health and safety of gas cabinet operators.

Gas panels are thus required to deliver gases at desired pressure levels while maintaining gas purity and maintaining safety integrity. The panels must also provide for purge functions to enable gas cylinder changes to be performed safely and without gas contamination. For such purposes, typical gas panels consist of specialized valves, components, interconnecting piping and associated hardware, with high purity, hazardous cylinders of gas being attached to the inlet to the gas panel, and the outlet thereof, attaching through a suitable pipeline to a process reactor.

A variety of gas panel arrangements have been proposed in the art to satisfy the various requirements for high purity process gas operations. In a representative gas panel, a flow limiting valve, an emergency shutoff valve, a gas regulator with high and low side gauges, and four manual valves are employed. A manual purge valve connects the nitrogen supply employed therein, and a manual process valve connects to the user system. Two vent valves connect the high and low side of the panel to vent means, including a vacuum generator module. The vacuum module contains an eductor driven by a nitrogen or other inert gas supply and exhausting to a vent stack system. A low side safety relief port connection to the vent stack is provided.

Despite such panel arrangements known in the art, there remains a genuine need for further gas panel improvements to meet the need for very high, or ultrahigh purity, gases to satisfy the ever increasing requirements of advanced process technologies for the semiconductor and other high technology industries. Such improvements must take into account that a large number of desired process gases are considered of a hazardous nature, i.e. are very toxic, corrosive, flammable or the like. The improvements desired in the art thus need to minimize contamination within the gas delivery panel and achieve enhanced control and handling of hazardous process gases.

It is an object of the invention, therefore, to provide an improved gas delivery panel.

It is another object of the invention to provide a gas panel capable of minimizing contamination of high purity process gases being delivered to a tool location.

It is a further object of the invention to provide an improved gas panel capable of enhancing the reliability and safety of high purity gas delivery operations.

With these and other objects in mind, the invention is hereinafter described in detail, the novel features thereof being particularly pointed out in the appended claims.

SUMMARY OF THE INVENTION

The invention comprises a gas panel of reduced size with an advantageous arrangement of specialized valves, pressure regulators and associated connections that serve to enhance gas supply purity and safety.

BRIEF DESCRIPTION OF THE DRAWING

The invention is hereinafter described in detail with reference to the accompanying single FIG. drawing illustrating the gas flow sequence of a typical embodiment of the gas delivery panels of the invention.

DETAILED DESCRIPTION OF THE INVENTION

The objects of the invention are accomplished by a reduced size, micropanel arrangement adapted to handle the unique problems associated with the control of ultra high purity hazardous gases. The reduced size and simplified flow arrangement of the invention reduces gas surface area, gas connections, and stagnant gas pockets, so as to reduce particulate or other contamination of process gas. It also reduces leak potential and provides for low pressure venting to increase system reliability and safety. The minimizing or elimination of contamination within the gas delivery panel is of critical importance to semiconductor and other advanced gas processing. The improved safety aspects of the invention are likewise a necessary part of the development of gas panels to satisfy the industrial requirements of advanced and future high purity gas processing operations.

The gas purity benefits of the micropanel of the invention, as contrasted to prior purge panel systems, are that (1) particle generation is reduced, because of the use of fewer components and moving parts and less wetted surface area; (2) particle entrapment areas are reduced, with a flow through configuration resulting in no appreciable dead leg areas, and the simplified design, with fewer components, mechanical connections and welds, further contributing to a desirable reduction in particle entrapment areas, and (3) gaseous contamination is minimized because of fewer leak potential areas being present, less wetted surface area being used, and fewer voids and entrapment areas existing, thereby enabling better and more complete purges to be carried out. The safety benefits of the micropanel configuration of the invention, compared to prior purge panel systems are that (1) the leak potential of the system is reduced because less mechanical connections, less seals to the atmosphere and less welds are employed; (2) the reliability of the gas panel system is enhanced because fewer components are employed and a simplified gas delivery operation is practiced; and (3) controlled low pressure venting is employed, which prevents accidental high pressure release of process gas.

With reference to the drawing, it will be appreciated that the gas delivery panel illustrated therein is the gas panel for one process gas, such as, for example, silane. In the overall practice of the invention, one or more, e.g. three, such gas delivery panels may be employed, with each panel being connected to a separate process gas cylinder for the delivery of process gas as desired for any particular semiconductor or other operation requiring the use of one or more ultrahigh purity process gases. The micropanel of the illustrated embodiment of the invention contains a purge gas valve, a pressure regulator, vent valve, test valve, process gas valve and vacuum generator module. The panel components are arranged and ported so that the gas flow path is preferably straight flow through, with minimum bends and stagnant gas pockets. For purposes of this invention, straight flow through gas passage will be understood to comprise a continuous flow path essentially without stagnant gas pockets, dead flow legs, and the like, on either side of the pressure regulator. The micropanel components are arranged such that the fluid passage parts therein are aligned essentially in the same plane, on both sides of the pressure regulator, to provide such straight flow through gas passage in preferred embodiments of the invention. The flow passages on the downstream side of the pressure regulator are commonly the same size as on the upstream side thereof, e.g. the ¼" industry standard, although it is also within the scope of the invention to employ flow passages of different sizes. As indicated above, this arrangement reduces undesirable particle contamination of the process gas flowing through the panel and maintains ultrahigh gas purity of the process gas being delivered from the process gas cylinder to the tool location.

In the embodiment of the drawing, the numeral 1 represents the purge gas valve, with pressure regulator 2, vent valve 3 and test valve 4 being arranged for preferred straight flow through gas passage. From test valve 4, process gas or nitrogen or other inert purge gas flows to process valve 5 for delivery to the tool location. From vent valve 3, purge gas flows through vacuum module 6 for venting from the gas panel.

Purge gas valve 1 has ports arranged so that, when said valve is closed, ports are open at the six and nine o'clock positions, whereas, when said valve is open, ports are open at the six, nine and twelve o'clock positions. Thus, when purge gas valve 1 is closed, process gas from a process gas supply cylinder connected to the panel passes to purge gas valve 1 for flow to pressure regulator 2, vent valve 3 and test valve 4. When, on the other hand, purge gas valve 1 is open, purge gas from a purge gas supply line passes to said purge gas valve for passage into the system, including the supply line from the process gas supply cylinder. In this regard, it should be noted that the process gas supply cylinder contains a valve that can be operated to control the passage of process gas to the system.

Pressure regulator 2 has flow through ports at three and nine o'clock positions, with transducer takeoffs at about five and seven o'clock positions. Thus, process gas or purge gas flows straight through pressure regulator 2, wherein the pressure is regulated from the higher process gas cylinder pressure to a desired lower pressure level for passage to the tool location or to the vent.

Vent valve 3 is located on the low pressure, downstream side only of pressure regulator 2, unlike particular prior art arrangements in which vent means are provided both upstream and downstream of the pressure regulator. Vent valve 3 has ports arranged so that, when said valve is closed, flow through open ports are permitted at the three and nine o'clock positions. When vent valve 3 is in an open position, a port at the twelve o'clock position is also open. Thus, when vent valve 3 is closed, process gas from pressure regulator 2 can flow straight through to test valve 4. When, on the other hand, vent valve 3 is open, process gas or purge gas can be passed separately from vent valve 3 to the vent stack system at low pressure as determined by the vacuum generator module.

Test valve 4, an optional but desirable feature of the invention and advantageously incorporated therein, as in the preferred straight flow through gas flow path in the gas panel, illustrated in the drawing, has ports arranged so that, when said valve is closed, ports are open at the three and twelve o'clock positions. When said valve is open, however, ports are open at the three, six and twelve o'clock positions. Thus, when test valve 4 is closed, process gas is passed to process valve 5. When test valve 4 is open, a portion of said process gas can be passed from the gas flow panel for testing. Test valve 4 can also desirably be used for other purposes, as for purging during system fabrication and for pressurization during external helium spray leak tests of the system. Thus, gas can be passed to or from the panel when the said test valve means is in its open position.

Process flow valve 5 has ports arranged in the six and twelve o'clock positions to control the flow of process gas to the tool location. When said process flow valve is open, the desired flow of process gas is accomplished, with said flow of process gas to the tool location being terminated when said process flow valve 5 is closed.

Vacuum generator module 6, which connects to the low pressure vent valve 3 when said valve is in the open position, utilizes a nitrogen or other inert gas supply and a conventional eductor to generate a vacuum, i.e. subatmospheric pressure, which is used in particular embodiments of the invention to facilitate the evacuation of gas from the gas panel, thereby exhausting the vacuum gas and the gas evacuated from the vent valve means in the panel to a vent stack system.

In the operation of the gas panel of the invention, preferably in the straight flow through embodiments thereof, process gas from cylinder 7 containing flow valve **7*a* passes in line 8 to purge gas valve 1, with or without the passage of purge gas thereto in line 9 from a source of purge gas supply, not shown. Gas passes from said purge gas valve 1 through line 10 to pressure regulator 2 for desired control of the process and purge gas pressure in the panel. High pressure transducer takeoff 11 is desirably positioned at the five o'clock position, and low pressure transducer takeoff 12** is desirably positioned at the seven o'clock position, for appropriate pressure use for control or display purposes.

From pressure regulator 2, gas passes in line 13 to vent valve 3, in which process gas passes desirably with straight flow through for passage in line 14 to test valve 4. Gas being vented is passed in line 15 to vacuum generator module 6, from which gas being vented is passed to a suitable stack system through line 16. Purge gas is passed from a source of purge gas supply, not shown, through line 17 to said vacuum generator module 6. Gas to be withdrawn from the gas panel for testing purposes passes from test valve 4 through line 18, while gas being passed to the tool location is passed from said test valve 4 in line 19 to process valve 5.

The low pressure side only vent arrangement of the invention allows safe and effective gas release from the gas panel. The high pressure side purge gas provides the necessary purge gas for the entire gas panel system. The panel provides the necessary components to connect the process gas cylinder to the process at the tool location and supply ultra clean and difficult to handle process gas supply in a simplified, convenient and advantageous manner. The micropanel arrangement of the invention allows desirable direct straight flow through passage of process gas from the process gas cylinder to the tool location. The test valve 4 arrangement allows system checkout without any compromise of system integrity. When a process gas cylinder is exhausted, the gas panel can be vented and purged, the cylinder can be changed, and the panel can be purged, tested and placed back in use to conveniently supply the desired process gas to the tool location.

Those skilled in the art will appreciate that various changes and modifications can be made in the details of the invention as described herein without departing from the scope of the invention as recited in the appended claims. While various commercially available seal means can be used in the practice of the invention, for example, Cajon VCR ® or Parker Vacuseal ® face seal fittings are commonly employed as the sealing means for the various components of the micropanel of the invention. Likewise, commercially available valves, such as Nupro valves, can be utilized in the practice of the invention. Similarly, commercially available pressure regulators and vacuum generator modules can be employed in the gas panels of the invention, e.g. Tescom pressure regulators or Span vacuum generator modules. Those skilled in the art will appreciate that the various components of the gas panel, such as the purge gas valve, pressure regulator, vent valve and test valve are provided with their fluid passage ports aligned so as to facilitate the straight flow through gas flow operation of the preferred embodiments of the invention.

While vacuum generator module 6 is employed in the illustrative embodiment shown in the drawing, it is within the scope of the invention to employ high pressure purge gas instead of a vacuum generator to facilitate the evacuation of gas being vented through the vent valve means. Thus, purge gas can be supplied at pressures typically in the range of about 300 to 500 psig or higher, while vacuum generators are commonly employed to generate a vacuum typically of about 22"–27" of mercury.

In the operation of the gas delivery panels of the invention, using either a vacuum generator or said high pressure purge, the purge operation essentially comprises pre- and post-cylinder change purge, as well as process gas purge, upon change-over from one process gas supply cylinder to another.

It will be understood that the materials of construction used in the invention are such as to be compatible with the process gases being employed, with stainless steel, e.g. 316L, being an industry standard. The purge gas employed will be nitrogen, argon or other inert gas that is non-toxic and non-reactive in the gas panel system.

It is within the scope of the invention to practice the invention in another desirable embodiment adapted to further minimize flow path surface area, gas connections, stagnant gas pockets, dead flow legs and the like. Thus, a single or unitary block of metal, e.g. stainless steel, or of other suitable material compatible with the gases being processed, can be machined to provide fluid passage ports for the interconnection of the valves and pressure regulator components necessary to carry out the low pressure only venting gas flow arrangement of the invention. The unitary metal block is adapted for the insertion therein of the purge gas valve means, pressure regulator means, vent valve means and process valve means for operation as described above, particularly in the preferred straight flow through gas passage embodiment of the invention. By the miniaturization of the unitary metal block and the associated components described above, including test valve means if so desired, it will be appreciated that the overall size of the gas delivery panel can be very appreciably reduced, with the gas flow paths of the system further minimized, and with the leak potential of the system likewise being further reduced, beyond that achieved in the embodiments of the micropanel of the invention as described above. The microblock version of the invention will thus be seen as a further, highly advantageous advance in the gas delivery panel art.

As indicated above, a gas cabinet for practical commercial operations may comprise more than one gas cylinder, e.g. three cylinders, each connected to a gas panel for the delivery of a particular gas to the tool location. For example, one cylinder may contain argon, oxygen, helium or nitrogen, etc., another may contain freon, nitrous oxide, sulfur hexafluoride or the like, and a third may contain ammonia, chlorine, dichlorosilane, hydrogen, hydrogen chloride, silane, silicon tetrachloride and the like.

The micropanel embodiments of the invention, including the microblock version thereof, represent a significant advance in the art, enhancing gas supply purity and the safety of its delivery from process gas supply cylinders to a tool location. The simplified gas panels of the invention reduce leak potential and enable low pressure venting so as to increase the reliability and safety characteristics of the gas panel. By reducing gas surface area and gas connections, and minimizing stagnant gas pockets, the high purity of the gas being supplied from gas cylinders is advantageously preserved at the high purity level necessary to satisfy the ever-increasing requirements of the semiconductor and other industries for high purity gas supply.

I claim:

1. An improved gas delivery panel for delivering high purity process gas from a supply cylinder to a tool location comprising;

(a) purge gas valve means adapted for operation between a closed position in which fluid passage ports are open for the passage of high purity process gas from a process gas supply cylinder through said purge gas valve means, and an open position in which fluid passage ports are open for said passage of high purity process gas therethrough or for the passage therethrough of purge gas from a purge gas supply line;

(b) pressure regulator means having flow passage ports for the passage of gas from said purge gas valve means therethrough, said pressure regulator means being adapted to regulate the pressure of gases passing therethrough;

(c) vent valve means positioned only on the low pressure side of said pressure regulator means and adapted for operation between a closed position in which fluid passage ports are open for the passage of high purity process gas or purge gas from said pressure regulator means, and an open position in which fluid passage ports are open for said passage of process gas or purge gas, and for the separate passage of said gas therefrom for venting; and (d) process flow valve means adapted for operation between an open position in which fluid passage ports are open for the passage of high purity process gas or purge gas therethrough for delivery to a tool location, and a closed position in which said passage of gas is terminated, whereby said gas delivery panel provides for a flow path minimizing has surface area, gas connections and stagnant gas pockets, thereby minimizing gas contamination and enhancing process gas purity, while simplifying gas flow paths, thereby reducing the potential for leaks and providing for low pressure venting, enhancing system reliability and safety.

2. The gas delivery panel of claim 1 in which the fluid passage ports of said valve means on both sides of said pressure regulator means are aligned essentially in the same plane to provide straight flow through gas passage therein.

3. The gas delivery panel of claim 1 in which said purge gas valve means, in its closed position, has open fluid passage ports in the six and nine o'clock positions for the passage of process gas therethrough, and, in its open position, has open fluid passage ports in the six, nine and twelve o'clock positions for the passage of purge gas therethrough.

4. The gas delivery panel of claim 1 in which said pressure regulator means has high pressure transducer means and low pressure transducer means positioned thereon.

5. The gas delivery panel of claim 4 in which said high pressure transducer means is positioned at the five o'clock position and said low pressure transducer means is positioned at the seven o'clock position.

6. The gas delivery panel of claim 1 in which said vent valve means, in its closed position, has open fluid passage ports at the three and nine o'clock positions for the passage of process gas or purge gas therethrough to said test valve means and, in its open position, has open fluid passage ports at the three, nine and twelve o'clock positions for the passage of process gas or purge gas also for venting.

7. The gas delivery panel of claim 1 in which said process flow valve means, in its open position, has open fluid passage ports for the passage of process gas or purge gas to the tool location, and, in its closed position, being adapted to preclude such passage of gas to the tool location.

8. The gas delivery panel of claim 1 including vacuum generator means adapted for the generation of a vacuum to facilitate the evacuation of gas passing from said vent valve means when said vent valve means is in an open position for venting.

9. The gas delivery panel of claim 8 in which said vacuum generator means comprises an eductor, and an inert gas supply means thereto for the generation of a subatmospheric pressure, and including a vent stack system for the low pressure venting of vacuum gas and gas evacuated from said vent valve means.

10. The gas delivery panel of claim 1 and including conduit means for establishing fluid communication between said purge gas valve means and a process gas cylinder.

11. The gas delivery panel of claim 10 and including conduit means for establishing fluid communication between said process flow valve means and said tool location.

12. The gas delivery panel of claim 1 and including test valve means adapted for operation between a closed position in which fluid passage ports are open for the passage of process gas or purge gas to said process flow valve means, and an open position in which gas can also be passed to or from gas supply or receiving means outside said panel.

13. The gas delivery panel of claim 12 in which said test valve means, in its closed position, has open fluid passage ports at the three and twelve o'clock positions for the passage of process gas or purge gas to said process valve means, and, in its open position, also has an open fluid passage port at the six o'clock position for the separate passage of gas to or from said panel.

14. The gas delivery panel of claim 12 in which said test valve means is positioned with the fluid passage ports thereof, and the fluid passage ports of the other valve means on both sides of said pressure regulator means, being aligned in essentially the same plane to provide straight flow through gas passage therein.

15. The gas delivery panel of claim 1 and including a unitary block of material adapted for the insertion of said purge gas valve means, pressure regulator means, vent valve means and process valve means, said unitary block being adapted to provide fluid passage ports for the interconnection of said valve and pressure regulator means therein.

16. The gas delivery panel of claim 15 in which said unitary block and valve and pressure regulator means are miniaturized to further simplify gas flow paths, reduce the potential for leaks and provide for said low pressure venting, thereby further enhancing gas panel system reliability and safety.

17. The gas delivery panel of claim 15 and including test valve means adapted for operation between a closed position in which fluid passage ports are open for the passage of process gas or purge gas to said process flow valve means, and an open position in which gas can also be passed to or from gas supply or receiving means outside said panel.

18. The gas delivery panel of claim 15 in which the fluid passage ports of said valve means on both sides of said pressure regulator means are aligned essentially in the same plane to provide straight flow through gas passage therein.

19. The gas delivery panel of claim 16 in which the fluid passage ports of said valve means on both sides of said pressure regulator means are aligned essentially in the same plane to produce straight flow through gas passage therein.

20. The gas delivery panel of claim 17 and including test valve means adapted for operation between a closed position in which fluid passage ports are open for the passage of process gas or purge gas to said process flow valve means, and an open position in which gas can also be passed to or from gas supply or receiving means outside said panel.

21. The gas delivery panel of claim 20 in which said unitary block and valve and pressure regulator means are miniaturized to further simplify gas flow paths, reduce the potential for leaks and provide for low pressure venting, thereby further enhancing gas panel system reliability and safety.

22. The gas delivery panel of claim 15 in which said unitary block of material comprises a metal block.

23. The gas delivery panel of claim 16 in which said unitary block of material comprises a metal block.

24. The gas delivery panel of claim 20 in which said unitary block of material comprises a metal block.

25. The gas delivery panel of claim 22 in which said unitary block comprises a stainless steel block.

26. The gas delivery panel of claim 23 in which said unitary block comprises a stainless steel block.

* * * * *